US010645478B2

(12) United States Patent
Pierce

(10) Patent No.: US 10,645,478 B2
(45) Date of Patent: May 5, 2020

(54) IN-EAR HEADPHONE FOR IMPROVED FIT AND FUNCTION, AND RELATED METHODS

(71) Applicant: Skullcandy, Inc., Park City, UT (US)

(72) Inventor: Andrew Pierce, Salt Lake City, UT (US)

(73) Assignee: Skullcandy, Inc., Park City, UT (US)

( * ) Notice: Subject to any disclaimer, the term of this patent is extended or adjusted under 35 U.S.C. 154(b) by 0 days.

(21) Appl. No.: 15/836,394

(22) Filed: Dec. 8, 2017

(65) Prior Publication Data

US 2019/0182576 A1 Jun. 13, 2019

(51) Int. Cl.
*H04R 1/10* (2006.01)
*H04R 1/28* (2006.01)

(52) U.S. Cl.
CPC ..... *H04R 1/1016* (2013.01); *H04R 1/2857* (2013.01)

(58) Field of Classification Search
CPC .. H04R 1/1016; H04R 1/1058; H04R 1/1066; H04R 1/1075; H04R 25/65–658
See application file for complete search history.

(56) References Cited

U.S. PATENT DOCUMENTS

| | | | |
|---|---|---|---|
| 5,949,896 | A | 9/1999 | Nageno et al. |
| 6,307,943 | B1 | 10/2001 | Yamagishi |
| 6,738,487 | B1 | 5/2004 | Nageno et al. |
| 7,349,550 | B2 | 3/2008 | Oliveira et al. |
| 7,616,772 | B2 | 11/2009 | Sabick et al. |
| 7,634,099 | B2 | 12/2009 | Harvey et al. |
| 7,916,888 | B2 | 3/2011 | Sapiejewski et al. |
| 8,238,596 | B2 | 8/2012 | Blanchard et al. |
| 8,571,227 | B2 | 10/2013 | Donaldson et al. |
| 8,611,581 | B2 | 12/2013 | Matsuo et al. |
| 8,660,289 | B2 | 2/2014 | Tiscareno |
| 8,670,586 | B1 | 3/2014 | Boyle et al. |
| 8,682,001 | B2 | 3/2014 | Annunziato et al. |
| 8,755,550 | B2 | 6/2014 | Monahan et al. |
| 8,913,773 | B2 | 12/2014 | Matsuo et al. |
| 8,983,101 | B2 | 3/2015 | Grinker et al. |
| 8,989,427 | B2 | 3/2015 | Silvestri et al. |
| 9,008,345 | B2 | 4/2015 | Matsuo et al. |
| 9,014,410 | B2 | 4/2015 | Matsuo et al. |
| 9,020,181 | B2 | 4/2015 | Matsuo et al. |
| 9,042,590 | B2 | 5/2015 | Silvestri et al. |

(Continued)

FOREIGN PATENT DOCUMENTS

| | | |
|---|---|---|
| JP | 2008-141691 | 6/2008 |
| WO | 2005/029909 A1 | 3/2005 |
| WO | 2016112217 A1 | 7/2016 |

OTHER PUBLICATIONS

Extended European Search Report for European Application No. 18206392, dated May 6, 2019, 7 pages.

*Primary Examiner* — Joshua Kaufman
(74) *Attorney, Agent, or Firm* — TraskBritt

(57) ABSTRACT

An earbud headphone includes a housing and an acoustic driver disposed within the housing between a front chamber and a rear chamber. The front chamber is defined between a front surface of the acoustic driver and a front wall of the housing, and the rear chamber is defined between a rear surface of the acoustic driver and a rear wall of the housing. The headphone further includes a sound guide tube configured to guide acoustic energy from the rear chamber to an ear canal of a user of the earbud headphone.

15 Claims, 6 Drawing Sheets

(56) References Cited

U.S. PATENT DOCUMENTS

| | | | | |
|---|---|---|---|---|
| 9,082,388 | B2 | 7/2015 | Annunziato et al. | |
| 9,179,212 | B2 | 11/2015 | Matsuo et al. | |
| 9,232,294 | B2 | 1/2016 | Matsuo et al. | |
| 9,269,342 | B2 | 2/2016 | Annunziato et al. | |
| 9,668,043 | B2 | 5/2017 | Paschel et al. | |
| 2007/0189570 | A1* | 8/2007 | Matsuo | H04R 1/1016 381/382 |
| 2008/0253604 | A1* | 10/2008 | Yamagishi | H04R 1/2819 381/379 |
| 2013/0266170 | A1 | 10/2013 | Yamagishi | |
| 2017/0311070 | A1* | 10/2017 | Igarashi | H04R 1/1016 |
| 2018/0020281 | A1* | 1/2018 | Wurtz | G10K 11/178 |

* cited by examiner

IN-EAR HEADPHONE FOR IMPROVED FIT AND FUNCTION, AND RELATED METHODS

TECHNICAL FIELD

The disclosure, in various embodiments, relates generally to a headphone and, more particularly, to an in-ear headphone having improved fit and function.

BACKGROUND

Conventional headphones exist in several configurations including what are referred to in the industry as in-ear, over-hear, and on-ear configurations. In-ear headphones are also referred to in the industry as "earbud" headphones. Headphones receive an electrical or electromagnetic signal from a media source, and include a transducer in the form of an acoustic driver (e.g., a speaker) that converts the electrical signal into an audible acoustic signal. Common media sources employed with headphones include, for example, mobile phones (e.g., smart phones), computers (e.g., desktop, laptop, and tablet computers), portable music players (e.g., MP3 players, compact disc players, cassette players, etc.), and gaming consoles. Headphones include wired headphones, which are coupled to a media source using a wire, and wireless headphones, which are operationally coupled to a media source by wireless (e.g., electromagnetic) signals (e.g., BLUETOOTH®). Some wireless headphones also may optionally be coupled to a media source using a wire, such as when the headphones have a low battery or in situations where wireless communication is prohibited.

The acoustic driver in conventional in-ear headphones is disposed within a housing and arranged such that the front surface faces toward the entrance of a user's ear canal. Thus, the acoustic energy waves emanate from the acoustic driver directly toward the ear canal of the user. In some in-ear headphone configurations, a sound guide tube guides the acoustic energy emitted from the acoustic driver from the headphone into the ear canal of the user. The sound guide tube extends from the front surface of the headphone housing, which faces the head of the user. The sound guide tube may extend away from the front surface of the housing at an angle relative to the geometric centerline of the headphone housing.

BRIEF SUMMARY

Various embodiments of the disclosure relate, generally, to an earbud headphone. The earbud headphone may include a housing, an acoustic driver, and a sound guide tube. The housing may include a front portion, a back portion, and side portions. The acoustic driver may be disposed within the housing, and may include a front surface facing toward the back portion of the housing. The acoustic driver may divide an interior space within the housing into a front cavity between the back portion of the housing and the acoustic driver and a rear cavity disposed between the front portion of the housing and the acoustic driver. The sound guide tube may extend from the housing and be located so as to guide sound from the front cavity out from the earbud headphone and toward the ear canal of the user when in use.

Other embodiments may relate, generally, to an earbud headphone. The earbud headphone may include a housing, an acoustic driver, and a sound guide tube. The housing may include a front portion, a back portion, and side portions. The acoustic driver may be disposed within the housing, and may include a front surface facing the back portion. The sound guide tube may extend from the back portion or the side portion of the housing toward and beyond the front portion of the housing.

Other embodiments may relate, generally, to an earbud headphone. The earbud headphone may include a housing, an acoustic driver, and a sound guide tube. The acoustic driver may be disposed within the housing between a front chamber and a rear chamber, the front chamber defined between a front surface of the acoustic driver and a rear wall of the housing. The rear chamber may be defined between a rear surface of the acoustic driver and a front wall of the housing. The sound guide tube may be configured to guide acoustic energy from the front chamber to an ear canal of a user of the earbud headphone.

Other embodiments of the disclosure relate, generally, to an earbud headphone system. The earbud headphone system may include an acoustic driver and a sound guide tube. The acoustic driver may include a front surface configured to emit acoustic energy in a first direction. The sound guide tube may be configured to guide acoustic energy emitted in a second direction by the acoustic driver from a rear cavity behind the acoustic driver within the housing to an ear canal of a user of the earbud headphone. In one embodiment, the first direction and the second direction are different.

BRIEF DESCRIPTION OF THE DRAWINGS

Purposes and advantages of the embodiments of the disclosure will be apparent to one of ordinary skill in the art from the detailed description in conjunction with the accompanying drawings.

DETAILED DESCRIPTION

The following description provides specific details to provide a thorough description of various embodiments of the invention. However, one of ordinary skill in the art will understand that the disclosed embodiments may be practiced without using these specific details. As used herein, the term "substantially" in reference to a given parameter, property, or condition means and includes, to a degree, that one of ordinary skill in the art would understand that the given parameter, property, or condition is met with a small degree of variance, such as, for example, within acceptable manufacturing tolerances. By way of example, depending on the particular parameter, property, or condition that is substantially met, the parameter, property, or condition may be at least 90% met, at least 95% met, or even at least 99% met.

As used herein, any directional term, such as "front," "back," "left," "right," "vertical," "horizontal" (e.g., "the front portion of the housing"), refers to a direction from the perspective of a user of the headphone(s) described herein. Such directional terms are used to describe features of the headphone(s) when the headphone(s) is positioned in an initial orientation prior to and for insertion and use in an ear of the user.

As used herein, "acoustic driver" means a device configured to contribute to the conversion of electric audio signals into acoustic energy using a transducer. Audio signals may include music or other media, speech (e.g., from a phone call), noise cancellation signals, and combinations thereof.

As known in the art, acoustic drivers include a rigid driver housing that includes an annular rim from which a flexible diaphragm is suspended. One of a permanent magnet and a coiled electrical wire (a "coil") is attached to the flexible diaphragm, and the other of the magnet and coil is attached to a portion of the driver housing adjacent the diaphragm in a fixed position. As electricity is driven through the coil, the electromagnetic forces between the magnet and coil cause the diaphragm to move (e.g., vibrate) relative to the rigid driver housing, which generates the sound emitted from the acoustic driver. As used herein, the "front surface" of an acoustic driver means the exterior surface of the acoustic driver on the side of the diaphragm opposite the magnet or coil that is fixedly attached to the rigid driver housing. As used herein, the "back surface" of an acoustic driver means the exterior surface of the acoustic driver opposite the front surface of the acoustic driver.

Figure 1:
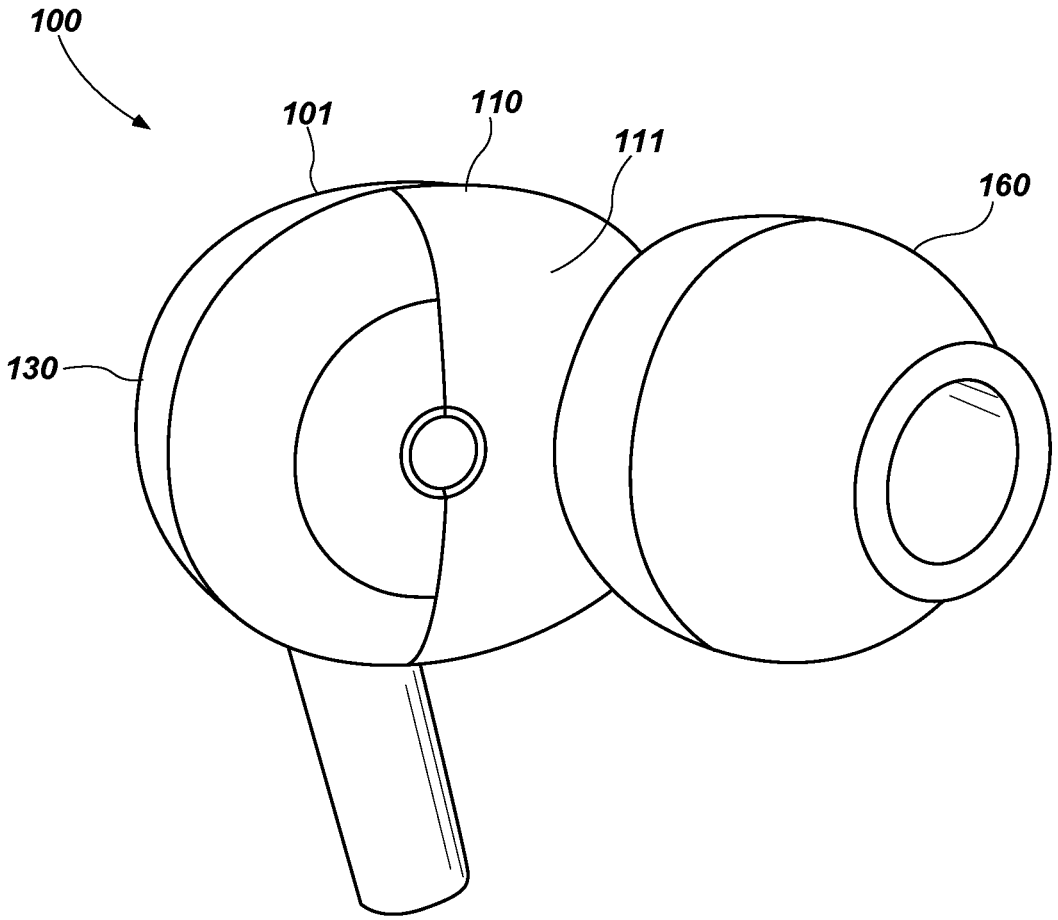
FIG. 1 shows an isometric view of a headphone in accordance with an embodiment of the disclosure.

FIG. 1 is a headphone 100, according to an embodiment of the disclosure. The headphone 100 includes a front housing 110 and a rear housing 130 that together comprise a housing 101. A deformable elastomeric component 160 is disposed on a sound guide tube 134 (not shown) to the side of the housing 101 and projects past an outer surface 111 of the front housing 110 such that the deformable elastomeric component 160 may be inserted into the ear canal of a human ear.

Figure 2:
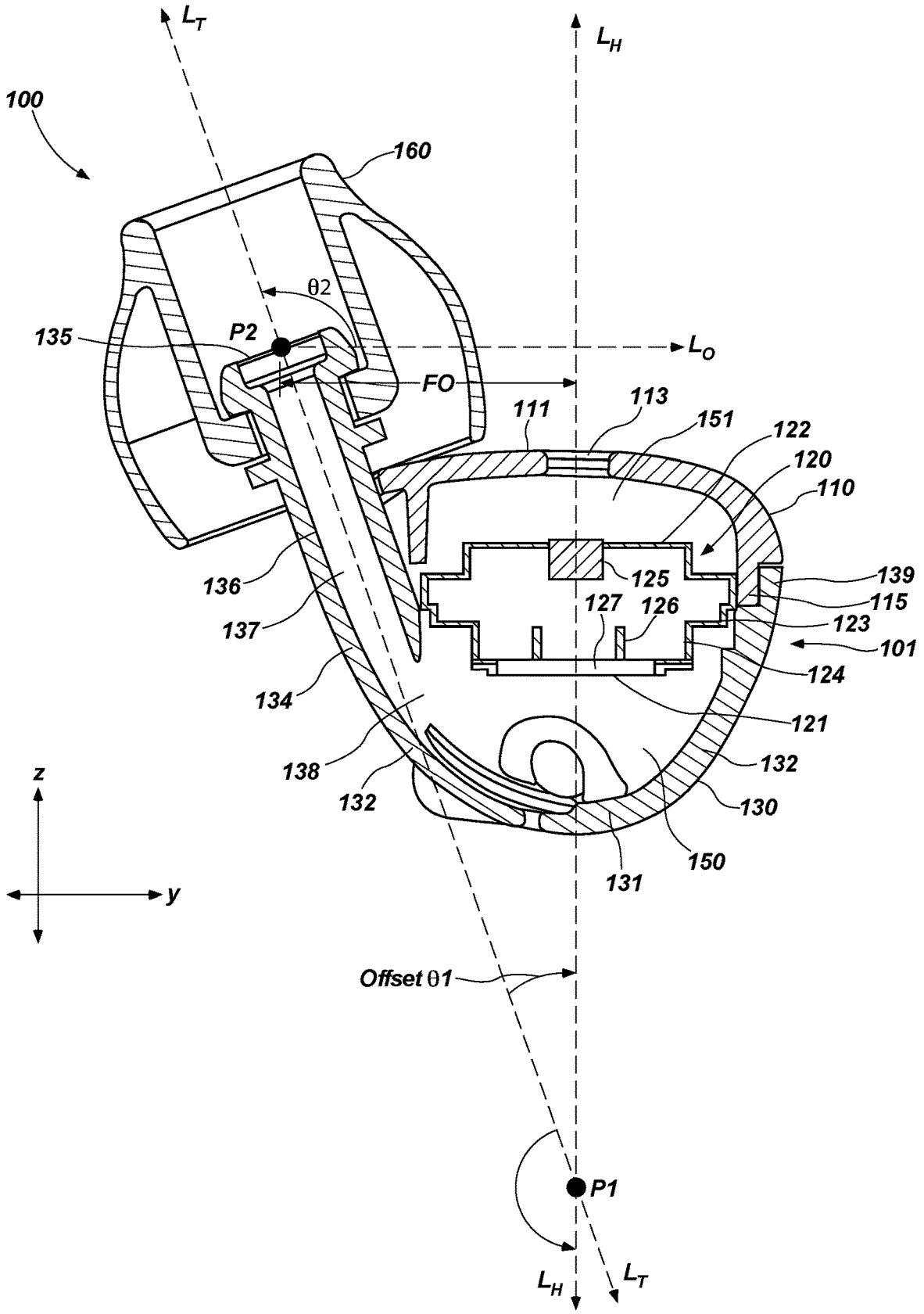
FIG. 2 shows a cross-sectional view of a headphone, in accordance with an embodiment of the disclosure.

FIG. 2 is a cross-sectional view of headphone 100, according to an embodiment of the disclosure. The headphone 100 includes a housing 101 and an acoustic driver 120 disposed within the housing 101. The front housing 110 and the rear housing 130 may be assembled together. When the front housing 110 and rear housing 130 are assembled together, the housing 101 has a front portion, a rear portion, and side portions. For example, the rear housing 130 may include a back wall 131 and side walls 132.

The rear housing 130 may further include a sound guide tube 134 that extends from the side walls 132 to beyond the front housing 110. The sound guide tube 134 protrudes from a surface of the rear housing 130 oriented at an angle relative to a geometric centerline $L_H$ of the headphone 100. The "geometric centerline" $L_H$ of the headphone 100, as that term is used herein, means the geometric centerline of the housing 101, excluding the sound guide tube 134. As shown in FIG. 2, a majority of the sound guide tube 134 may be substantially straight and oriented along an axis $L_T$, which is oriented at an angle Θ1 with respect to the geometric centerline $L_H$ of the headphone 100. The angle may be, for example, between about 5° and about 50°.

The distal end 135 of the sound guide tube 134 may be configured for insertion into an ear canal of a human ear (not shown). The sound guide tube 134 may be configured to carry a deformable elastomeric component such as deformable elastomeric component 160, often referred to in the industry as a "gel" member or a "sleeve." The deformable elastomeric component 160 is configured (e.g., in terms of size and shape) to interface with an inner surface of the auditory canal of a user to retain the sound guide tube 134 and the headphone 100 in position in the ear of the user while the headphone 100 is in use. By way of example and not limitation, the deformable elastomeric component 160 may be configured as described in U.S. Pat. No. 9,668,043 to Paschel et al., entitled "ELASTOMERIC COMPONENT FOR EARBUD HEADPHONES AND HEADPHONES INCLUDING SUCH ELASTOMERIC COMPONENTS," and issued May 30, 2017, the entire contents and disclosure of which are incorporated herein by this reference.

In some embodiments, the sound guide tube 134 may be integrally formed with the rear housing 130.

The walls 136 of the sound guide tube 134 may define a sound guide chamber 137 therein. A sound guide opening 138 may operatively couple the sound guide chamber 137 to an interior of the rear housing 130. The sound guide opening 138 may have a first perimeter defined by an inner surface of the side walls 132, and a second perimeter defined by an outer surface of the side walls 132. In some embodiments, the first and second perimeters of the sound guide opening 138 may be defined by inner and outer surfaces of the back wall 131, defined by the inner and outer surfaces of the side walls 132, or defined by a combination of the inner and outer surfaces of the back wall 131 and the side walls 132. The walls that define the sound guide opening 138 may be a feature of the location on the housing 101 where the sound guide tube 134 attaches to or, is integrated with, the housing 101.

In one embodiment, the rear housing 130 may be comprised of rigid material, for example, rigid plastic, polyvinyl chloride (PVC), acrylonitrile-butadiene-styrene (ABS), polycarbonate (PC), nylon, aluminum, or steel. In another embodiment, the rear housing 130 may be comprised of a flexible material, for example, a flexible plastic, rubber, silicone, a thermoplastic elastomer (TPE), or a thermoplastic polyurethane (TPU).

The front housing 110 may include one or more ports 113. In one embodiment, the ports 113 are acoustic tuning ports. The ports 113 may be configured to increase the efficiency of the system, for example, at low frequencies, as well as to facilitate air to move into, and out of, the headphone 100. Facilitating air to move may enable greater movement of a flexible diaphragm 127 relative to a rigid frame 124. In various embodiments the ports 113 may be holes, arches, etc.

In one embodiment, the front housing 110 may be comprised of a rigid material, for example, rigid plastic, PVC, ABS, PC, nylon, aluminum, steel. In another embodiment, the front housing 110 may be comprised of a flexible material, for example, a flexible plastic, rubber, silicone, TPE, or TPU. The acoustic driver 120 may include a magnet 125 and a coil 126, each attached to a rigid frame 124. A flexible diaphragm 127 is attached to the coil 126. As already noted, above, as electricity is driven through the coil 126, the electromagnetic forces between the magnet 125 and coil 126 cause the flexible diaphragm 127 to vibrate relative to the rigid frame 124, which generates the sound emitted from the acoustic driver 120.

The front housing 110 may include attachment portions 115 that are operable to engage with receiving and retaining portions 139 of the rear housing 130 such that the front housing 110 and the rear housing 130 may be coupled by way of ultrasonic welding or adhesive. In other embodiments, the front housing 110 and the rear housing 130 may be coupled by soldering, or fasteners.

In various embodiments, the size of the acoustic driver 120 may be selected based on design constraints. For example, an acoustic driver 120 may be selected that has a size in a range from about 6 mm to about 16 mm. The acoustic driver 120 may be configured to be disposed within the rear housing 130. In some embodiments, the rear housing 130 and the acoustic driver 120 may be coupled by soldering, ultrasonic welding, adhesive, fasteners, or combinations thereof. In various embodiments, the rigid frame 124 may be coupled to one or more points of the front housing 110 and the rear housing 130.

The front surface 121 of the acoustic driver 120 and the rear housing 130 may define a forward chamber 150. The rear surface 122 of the acoustic driver 120 and the front housing 110 may define a rearward chamber 151. The forward chamber 150 may be operatively coupled to the sound guide chamber 137 by the sound guide opening 138. In operation, acoustic energy emitted from the acoustic driver 120 may propagate into an ear canal by way of the forward chamber 150, the sound guide opening 138, and the sound guide chamber 137.

While the headphone 100 is in use, an acoustic chamber may be defined by the forward chamber 150, sound guide tube 134 chamber, and a volume of a user's ear canal. The volume of a user's ear canal dominates the volume of the forward chamber 150 in terms of the effect on acoustic performance of the acoustic chamber. Thus, in some embodiments, the volume of the forward chamber 150 may be minimized without affecting the acoustic performance of the headphone 100, for example, to reduce the overall size of the headphone 100. The volume of the rearward chamber 151 may be selected, in part, based on the space in the housing 101 used to accommodate the acoustic driver 120. The volume of the rearward chamber 151 may also be selected to accommodate pressure changes inside the headphone 100 while the acoustic driver 120 is operating. In one embodiment, the volume of the acoustic chamber is about 2000 $mm^3$ or greater, and the volume of the reward cavity is about 50 $mm^3$ or greater.

In other embodiments, the volume of forward chamber 150 may be selected to accommodate other devices/units, for example, noise reduction circuitry, cables, cable knots, crimping, and combinations thereof.

As illustrated in FIG. 2, the sound guide tube 134 protrudes from a surface of the rear housing 130, and deviates in the y-axis direction from the centerline $L_H$ of the housing 101. The axis $L_T$ of the sound guide tube 134 may be offset in the y-axis direction by a predetermined offset angle $\Theta$ with reference to the centerline $L_H$ of the housing 101.

An intersection point $P_1$ may be determined by the axis $L_T$ of the sound guide tube 134 and the centerline $L_H$ of the housing 101. An offset angle $\Theta$ may be defined about the intersection point $P_1$ as the angle between $L_T$ and $L_H$. Notably, in the embodiment shown in FIG. 2, $P_1$ is in-front of the acoustic driver 120 and behind the headphone 100.

A front offset FO may be defined by a distance in the y-axis direction from the centerline $L_H$ of the headphone 100 to the center point $P_2$ of the distal end 135 of the sound guide tube 134. The front offset FO may be, for example, between about 4 mm and about 35 mm.

Figure 3:
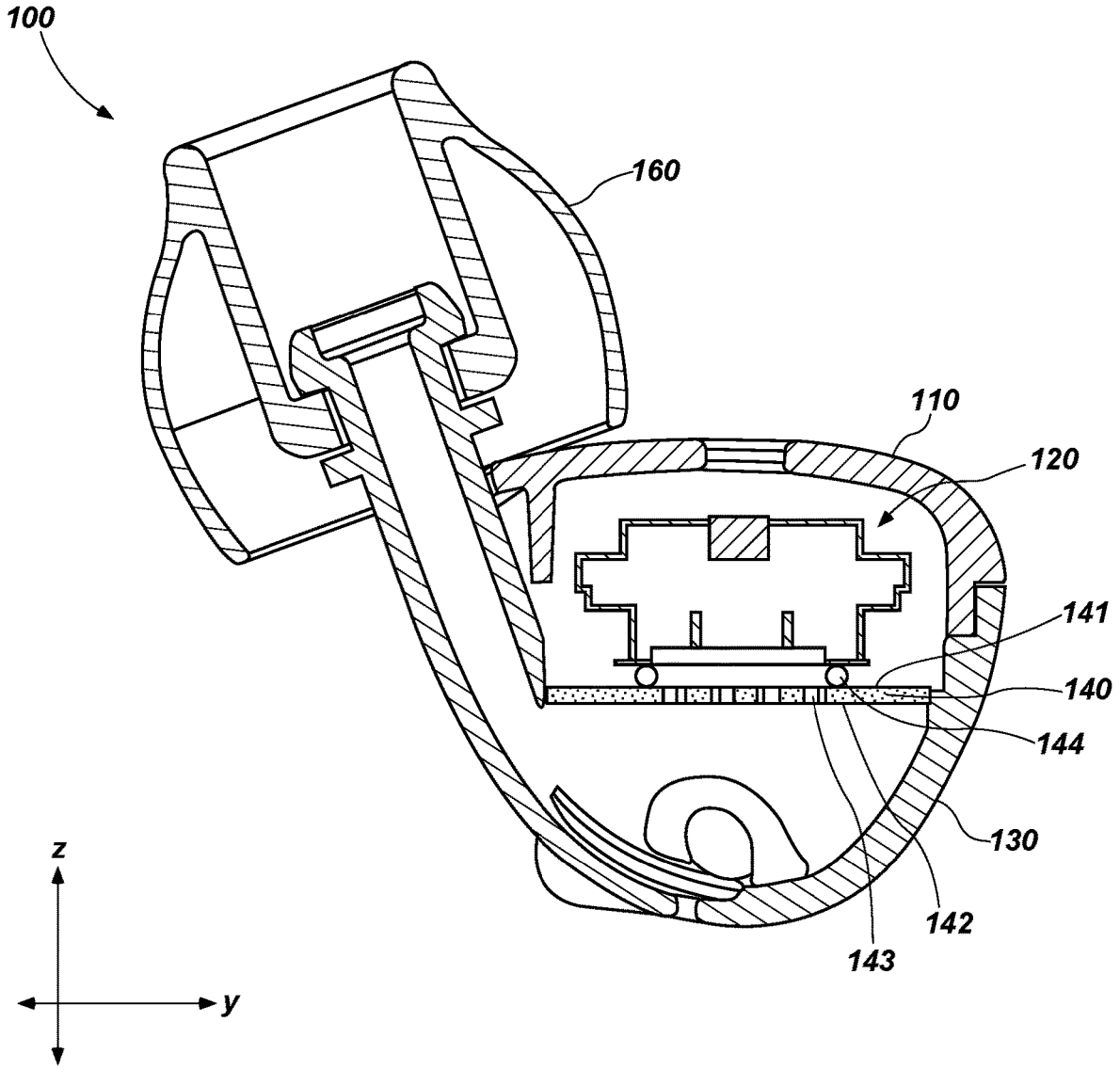
FIG. 3 shows a cross-sectional view of a headphone, in accordance with an embodiment of the disclosure.

FIG. 3 is cross-sectional view of a headphone 100, including an optional attachment plate 140, according to an embodiment of the disclosure. In some embodiments where rear housing 130 is made of a rigid material, it may be preferable to use an attachment plate 140 as an attachment element. The attachment plate 140 may include a first surface 141, a second surface 142, and may define one or more holes 143. The one or more holes 143 may extend through the attachment plate 140 from the first surface 141 to the second surface 142. In one embodiment, the attachment plate 140 may have a shape that is substantially the same as a cross-section of the acoustic driver 120. The shape of the cross-sections of the holes 143 may be, for example, circular, oval, square, triangular, arcs, semi-circular, tear drop, or combinations thereof.

The attachment plate 140 may be attached to the rear housing 130, for example, by adhesive. The acoustic driver 120 may be attached to the first surface 141 of the attachment plate 140. In one embodiment, the attachment plate 140 may be a printed circuit board, and the front surface 121 of the acoustic driver 120 may be affixed to the first surface 141 of the attachment plate 140 by one or more solder balls 144. The acoustic driver 120 and the attachment plate 140 may be arranged relative to each other such that the acoustic energy emitted from the acoustic driver 120 passes through one or more of the holes 143 defined by the attachment plate 140. In some embodiments, the position and shape of the holes 143 may be selected to facilitate passage of acoustic energy emitted from the acoustic driver 120 through the holes 143.

Figure 4:
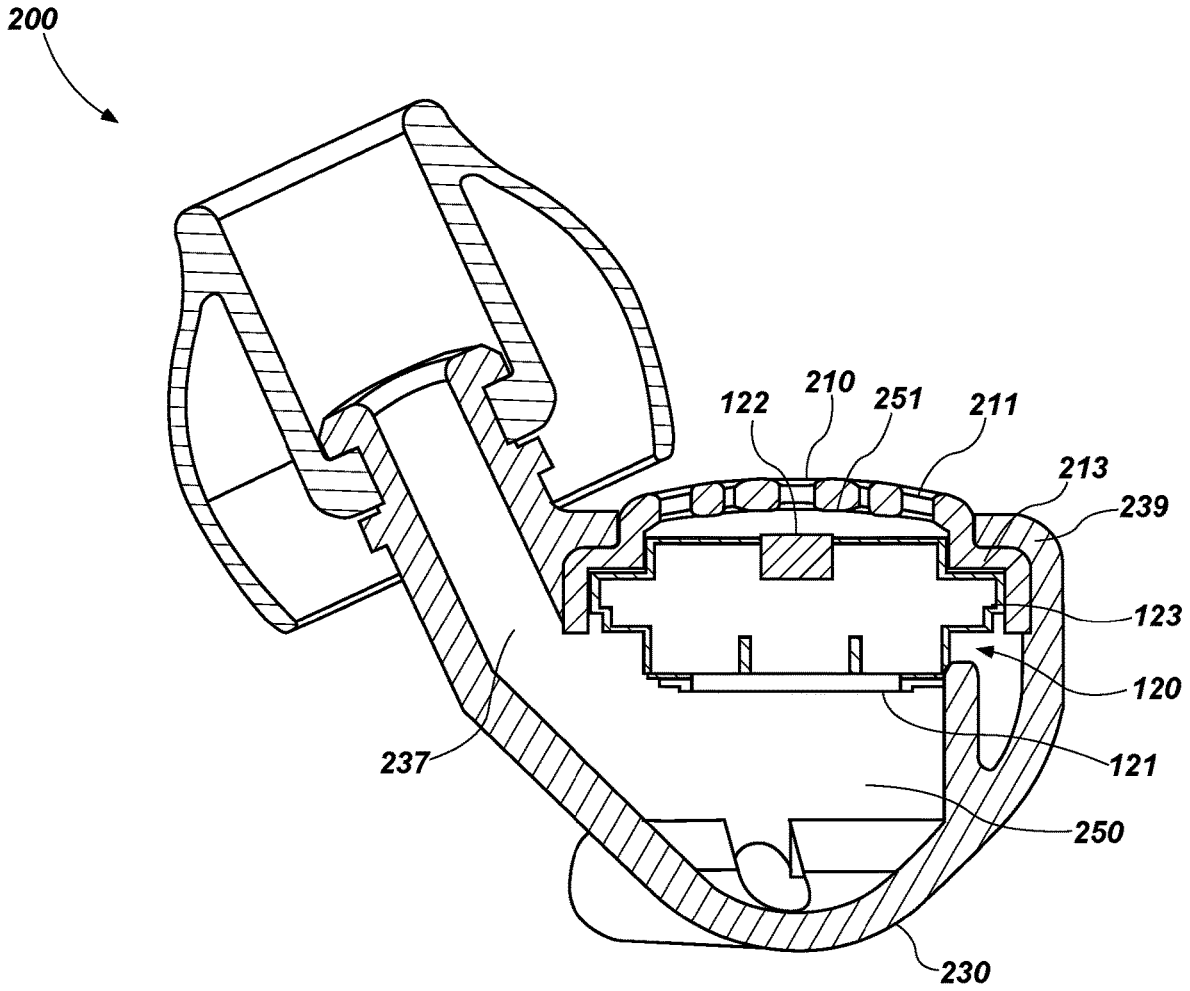
FIG. 4 shows a cross-sectional view of a headphone, in accordance with an embodiment of the disclosure.

FIG. 4 is a cross-sectional view of a headphone 200, according to an embodiment of the disclosure. The headphone 200 may include an acoustic driver 120, a rear housing 230, and a front housing 210. The front housing 210 is disposed close to the rear surface 122 of the acoustic driver 120. In one embodiment, the front housing 210 may abut one or more contact points on the rear surface 122, though it is not required. Notably, the region defined by the front housing 210 and the rear surface 122 of the acoustic driver 120 is minimized compared to the 150 region defined by the front housing 110 and the rear surface 122 illustrated in FIG. 2.

In the embodiment shown in FIG. 4, the acoustic driver 120 is disposed within the rear housing 230. The acoustic driver 120 may include one or more attachment portions 123 (see also FIG. 2) that are configured to engage with receiving and retaining portions 239 of the rear housing 230 such that the acoustic driver 120 and rear housing 230 are mechanically coupled. Alternatively or in addition, the acoustic driver 120 and rear housing 230 may be coupled by soldering, ultrasonic welding, adhesive, fasteners, or combinations thereof.

The front housing 210 may include attachment portions 213 that are configured to engage with receiving and retaining portions 239 of the rear housing 230 such that the front housing 210 and the rear housing 230 are mechanically coupled. Alternatively or in addition, the front housing 210 and rear housing 230 may be coupled by soldering, ultrasonic welding, adhesive, fasteners, or combinations thereof.

In one embodiment, the rear housing 230 may be comprised of a rigid material, for example, rigid plastic, PVC, ABS, PC, nylon, aluminum, steel. In another embodiment, the rear housing 230 may be comprised of a flexible material, for example, a flexible plastic, rubber, silicone, TPE, or TPU. The front housing 210 may be comprised of a rigid or flexible material, and in one embodiment the front housing 210 may be comprised of a material that is more rigid than a material of the rear housing 230.

In one embodiment, the front housing 210 is a speaker grill, and may define one or more vent openings 211. The vent openings 211 open the front of the headphone 200 to the surrounding environment. Thus, a rearward chamber 251 defined by the front housing 210 and the rear surface 122 of the acoustic driver 120 may be considered fully open and/or the volume of the rearward chamber 251 may be considered infinite for design purposes. A forward chamber 250 may be defined by the front surface 121 of the acoustic driver 120 and the rear housing 230. The forward chamber 250, sound guide chamber 237, and a user's ear canal (not shown) may form an acoustic chamber (not shown).

Figure 5:
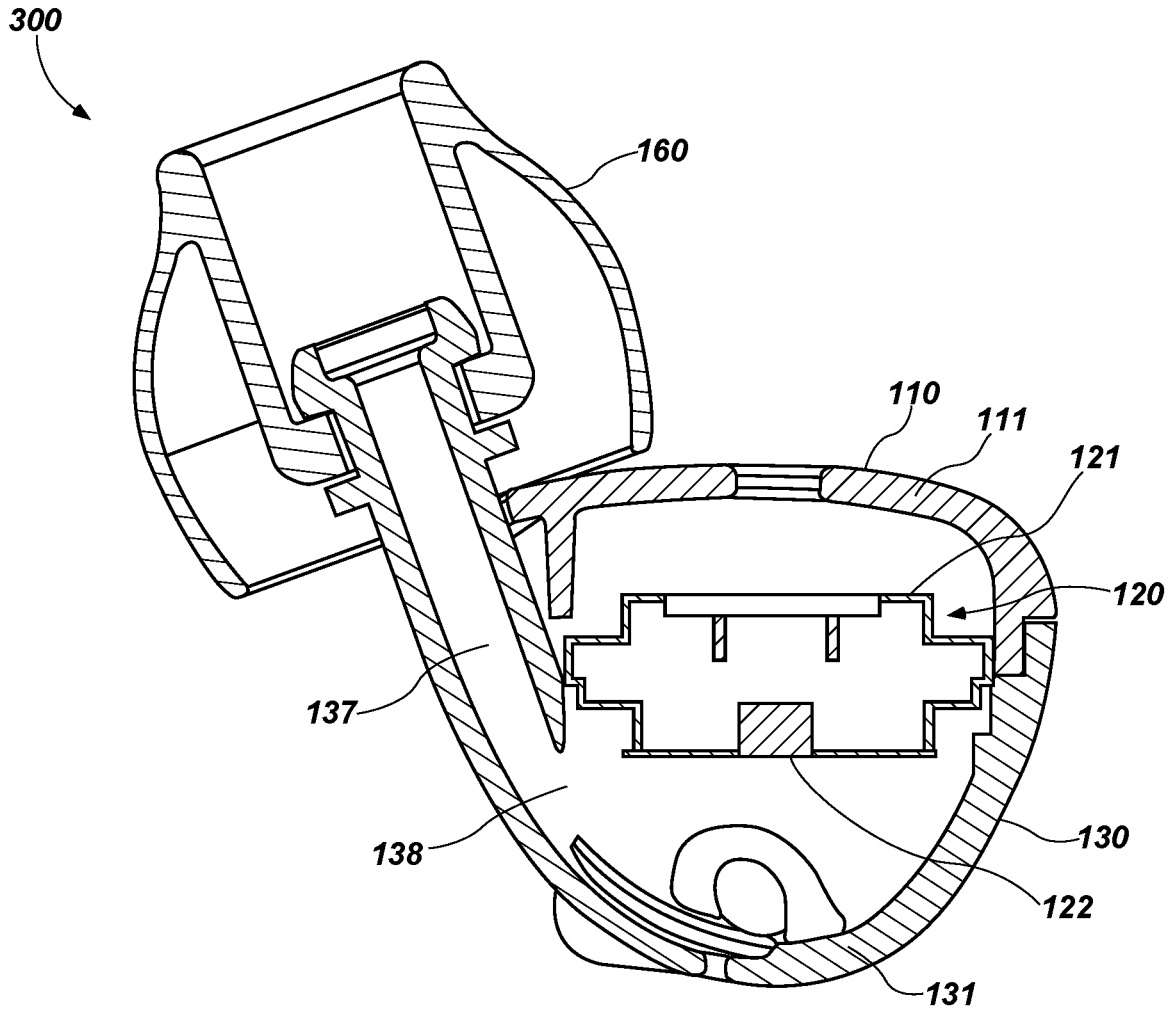
FIG. 5 shows a cross-sectional view of a headphone, in accordance with an embodiment of the disclosure.

FIG. 5 shows a cross-sectional view of a headphone 300, according to an embodiment of the disclosure. The headphone 300 includes a front housing 110, an acoustic driver 120, and a rear housing 130. Unlike the embodiments shown in FIGS. 2 to 4, in the embodiment shown in FIG. 5 the orientation of the acoustic driver 120 is forward facing, that is, the front surface 121 is substantially facing the front housing 110 and the rear surface 122 is substantially facing the back wall 131.

Figure 6:
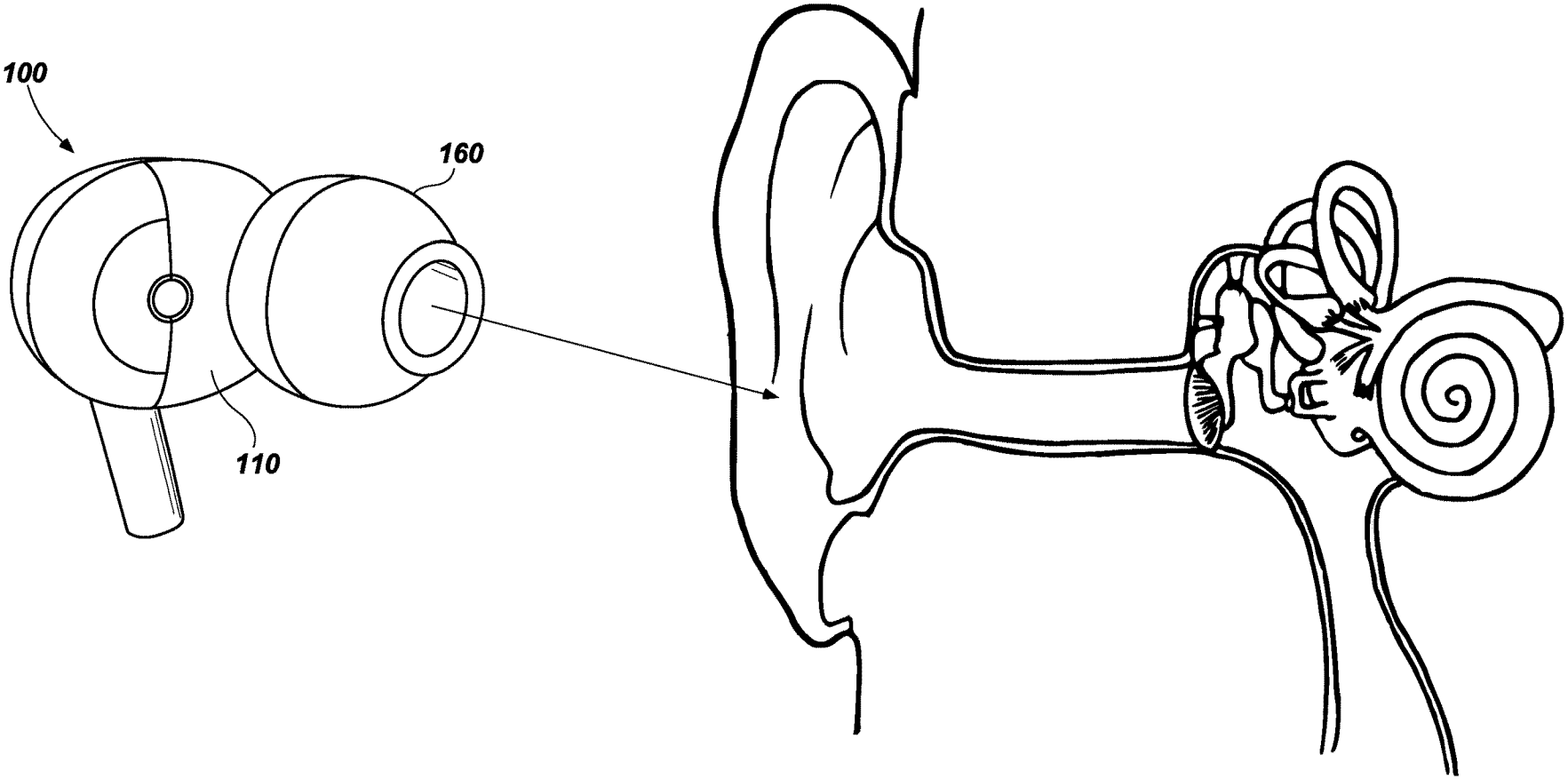
FIG. 6 shows a headphone being inserted into a user's ear canal.

FIG. 6 shows a headphone 100 being inserted into an ear canal of a user, in accordance with an embodiment of the disclosure. While the headphone 100 is inserted into the user's ear canal, the front housing 110 substantially faces the user's head. The sound guide chamber 137 (not shown) couples the ear canal to the forward chamber 150 (not shown), and the forward chamber 150, sound guide chamber 137, and volume of the ear canal define the acoustic chamber (not shown). In operation, the acoustic energy emitted from the front surface 121 of the acoustic driver 120 propagates by way of the acoustic chamber to the user.

One of ordinary skill in the art will appreciate that an acoustic driver 120 that is disposed in a forward facing arrangement, such as the one described with reference to headphone 300 (see FIG. 5), may also be used.

The features of the various embodiments described herein are not mutually exclusive and can exist in various combinations and permutations, even if such combinations or permutations are not expressly described herein, without departing from the scope of the disclosure. In fact, variations, modifications, and other implementations of what is described herein will occur to one of ordinary skill in the art without departing from the scope of the disclosure. As such, the invention is not to be defined only by the preceding illustrative description, but only by the claims which follow, and legal equivalents thereof.

I claim:

1. An earbud headphone, comprising:

a housing comprising a front portion, a back portion, and side portions;

an acoustic driver disposed within the housing, the acoustic driver including a diaphragm, the acoustic driver dividing an interior space within the housing into a front cavity between the rear portion of the housing and the acoustic driver and a rear cavity disposed between the front portion of the housing and the acoustic driver, wherein the diaphragm faces the front cavity; and a sound guide tube extending substantially linearly from a first end connected to the housing to an opposite second end located beyond the front portion of the housing such that a straight line extends through the sound guide tube from the first end to the opposite second end, wherein the sound guide tube is located so as to guide sound from the front cavity out from the earbud headphone and toward an ear canal of a user when in use.

2. The earbud headphone of claim 1, wherein the sound guide tube extends from the back portion or a side portion of the housing.

3. The earbud headphone of claim 2, wherein a majority of a length of the sound guide tube is at least substantially straight and oriented at an angle to a geometric centerline of the housing.

4. The earbud headphone of claim 3, wherein the angle is between about 5° and about 50°.

5. The earbud headphone of claim 1, further comprising a deformable member carried on a distal end of the sound guide tube and configured to form a seal between the sound guide tube and the ear canal of a user when in use.

6. An earbud headphone, comprising:

a housing comprising a front portion, a back portion, and side portions, wherein the front portion comprises a feature defining an acoustic port;

an acoustic driver disposed within the housing, the acoustic driver including a diaphragm facing the back portion and dividing an interior space within the housing into a front cavity between the rear portion of the housing and the acoustic driver and a rear cavity disposed between the front portion of the housing and the acoustic driver; and a sound guide tube extending from a first end connected to the housing to an opposite second end located beyond the front portion of the housing such that a straight line extends through the sound guide tube from the first end to the opposite second end, wherein the sound guide tube is located so as to guide sound from the front cavity out from the earbud headphone and toward an ear canal of a user when in use.

7. The earbud headphone of claim 6, wherein at least a majority of a length of the sound guide tube is straight and oriented at an angle relative to a central geometric axis of the housing, the angle being within a range extending from about 5° and about 50°.

8. The earbud headphone of claim 6, further comprising a deformable member carried by the sound guide tube and configured to form a seal between the sound guide tube and an ear canal of a user when in use.

9. An earbud headphone, comprising:

a housing having a front wall and a rear wall;

an acoustic driver disposed within the housing between a front chamber and a rear chamber, the front chamber defined between the acoustic driver and rear wall of the housing, the rear chamber defined between the acoustic driver and front wall of the housing, wherein the acoustic driver includes a diaphragm facing the rear wall of the housing; and a sound guide tube configured to guide acoustic energy from the rear chamber to an ear canal of a user of the earbud headphone, wherein the sound guide tube extends along a substantially straight line from the rear chamber and beyond the front chamber of the housing such that a straight line extends through the sound guide tube from the first end to the opposite second end.

10. The earbud headphone of claim 9, wherein the housing is configured to rest in an ear canal of a user of the earbud headphone when the headphone is in use, and the ear canal of the user of the earbud headphone is located closer to the rear chamber than to the front chamber when the earbud headphone is in use.

11. The earbud headphone of claim 9, wherein a majority of a length of the sound guide tube is straight and oriented at an angle relative to a geometric centerline of the housing.

12. The earbud headphone of claim 11, wherein at least a portion of a passageway extending through the sound guide tube is curved.

13. An earbud headphone system, comprising:

a housing comprising a front portion and a back portion;

an acoustic driver disposed within the housing and comprising a diaphragm configured to emit acoustic energy in a first direction, the acoustic driver dividing an interior space within the housing into a front cavity between the back portion of the housing and the acoustic driver and a rear cavity disposed between the front portion of the housing and the acoustic driver, the diaphragm facing the front cavity; and a sound guide tube configured to guide the acoustic energy in a second direction from the front cavity within the housing to an ear canal of a user of the earbud headphone system, wherein the first direction and the second direction are different, wherein the sound guide tube extends substantially linearly from the front cavity toward and beyond the front portion of the housing.

14. The earbud headphone system of claim 13, wherein a majority of a length of the sound guide tube is straight and oriented at an angle relative to a geometric centerline of the housing of between about 5° and about 50°.

15. The earbud headphone system of claim 14, wherein at least a portion of an inner passageway of the sound guide tube is curved.

* * * * *